US005553722A

United States Patent [19]

Lam

[11] Patent Number: 5,553,722

[45] Date of Patent: Sep. 10, 1996

[54] TOWEL RACK

[76] Inventor: Ching-Keung Lam, Flat B-6, 4/F, Eastern Block, Pearl Island Villas, Pearl Island, Castle Peak, NT, Hong Kong

[21] Appl. No.: 382,279

[22] Filed: Feb. 1, 1995

[51] Int. Cl.[6] ..... A47F 7/00

[52] U.S. Cl. ..... 211/99

[58] Field of Search ..... 211/99, 100, 105.3, 211/16, 123

[56] References Cited

U.S. PATENT DOCUMENTS 3,032,273 5/1962 Spielman ..... 211/105.3 X 4,611,721 9/1986 Heckaman ..... 211/99 X

*Primary Examiner*—Ramon O. Ramirez
*Assistant Examiner*—Sarah L. Purol
*Attorney, Agent, or Firm*—Wolf, Greenfield & Sacks, P.C.

[57] ABSTRACT

A towel rack is provided comprising a support member 1 adapted to be removably mountable to a wall, and a plurality of towel rails 18 which may be engaged to the support member at selected locations and in selected configurations by a user. Such an arrangement provides efficent use of space, versatility and the ability to remove the rails and/or support member when not required.

9 Claims, 5 Drawing Sheets

TOWEL RACK

FIELD OF THE INVENTION

This invention relates to a towel rack, and in particular the invention relates to a towel rack having a high degree of versatility and the configuration of which may be selected and varied by a user at will.

BACKGROUND OF THE INVENTION

A known problem with bathrooms-is finding adequate hanging space for towels. This applies in particular to wet towels after they have been used. Dry towels can be folded and stacked upon each other, but wet towels must be hung individually to allow them to dry. Leaving a bathroom full of wet towels not properly hung to dry is unpleasant and potentially unhygienic. It would be desirable therefore to provide means for facilitating the hanging of wet towels while they dry, and which of course may if desired also be used to hang the towels neatly and tidily when they are dry, and which also may be employed to hang other items such as clothes, both when wet and dry.

PRIOR ART

The most traditional method of hanging a towel in a bathroom (or for that matter in another room such as a kitchen) is from a fixed towel rail. Such a rail is mounted horizontally to a wall and spaced a short distance therefrom to allow towels etc to be hung to dry. Such a traditional towel rail has a number of disadvantages. It is inefficient in its use of space, it continues to take up space when not in use, and it lacks versatility in its method of use.

The first of these problems can to a certain extent be overcome by providing a plurality of towel rails located at different heights and possibly different wall spacings. This may go someway to meeting the problem of inefficient use of space, but it does not solve the remaining problems of traditional towel rails—indeed arguably it may make matters worse, particularly with regard to the problem of the obstruction caused by the towel rails when not in use.

Various types of towel racks are known which have attempted to give a user greater versatility. Many of these are mounted to a wall in use. One known type of towel rack, for example, comprises a plurality of towel rails fixed to a wall. The rails are mounted for pivotal movement so that they may be rotated between a position in which they lie parallel and adjacent the wall when not required, and a position in which they extend away from the wall when they are in use. This provides a certain degree of versatility, and better use of space than fixed towel rails, but by no means is such a design a perfect solution to the problems mentioned above—for example, the towel rails still present a degree of obstruction when not in use.

To date there remains a need for a versatile towel rail, having a maximum efficiency in its use of space when in use, and minimum obstructive qualities when not in use.

SUMMARY OF THE INVENTION

According to the present invention there is provided a towel rack comprising, a support member, said support member being adapted to be mounted to a wall in use so as to extend away from said wall, and a plurality of towel rails adapted to receive towels thereon when in use, said support member being provided with a plurality of engagement locations, and said rails each being adapted to be releasably engageable with said support member at a said engagement location.

By means of this arrangement a more versatile and efficient towel rack may be provided. Since the towel rails are releasably engageable with the support member, only as many rails as are required need be used. Furthermore by providing the support member with a plurality of engagement locations the positions of the rails which are fixed to the support member may be chosen by a user as the circumstances dictate.

Preferably the towel rails are telescopic so that not only their position but also their length can be chosen by a user. Other preferred possibilities include that the support member is adapted for rotation in a vertical plane perpendicular to the wall such that the angle of the support member relative to the wall may be adjusted. This amongst other things permits the height of the towel rails relative to the floor to be adjusted. Means are preferably provided to lock the suppport member at a chosen angle.

In a preferred embodiment the support member is removably mountable to the wall so that when not in use the support member can be removed out of the way. When required the support member can be simply replaced.

Preferably each said engagement location comprises an aperture in the support member, and each said towel rail is provided at one end thereof with a pair of spaced apart resilient locking arms, said locking arms being spaced apart by a distance slightly greater than the width of said apertures. More preferably still the support member is hollow and complementary apertures are provided on each side of the support member, the length of said locking arms being slightly greater than the width of said support member such that the locking arms will extend through both a first aperture on one side of the support member and a complementary second aperture on the opposed side of the support member, and the free ends of the locking arms are provided with locking lugs for engaging the edges of the second complementary aperture. In this embodiment it is also preferred to provide seperate locking members adapted to be received between said locking arms so as to urge said arms apart and into engagement with the edges of said apertures.

DETAILED DESCRIPTION OF PREFERRED EMBODIMENT

Figure 1:
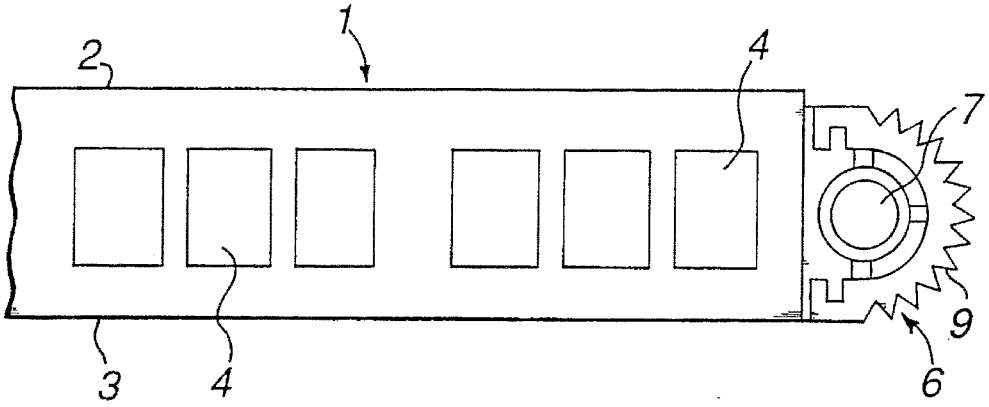
FIG. 1 is a view from one side of a support member according to one embodiment of the invention.
Figure 2:
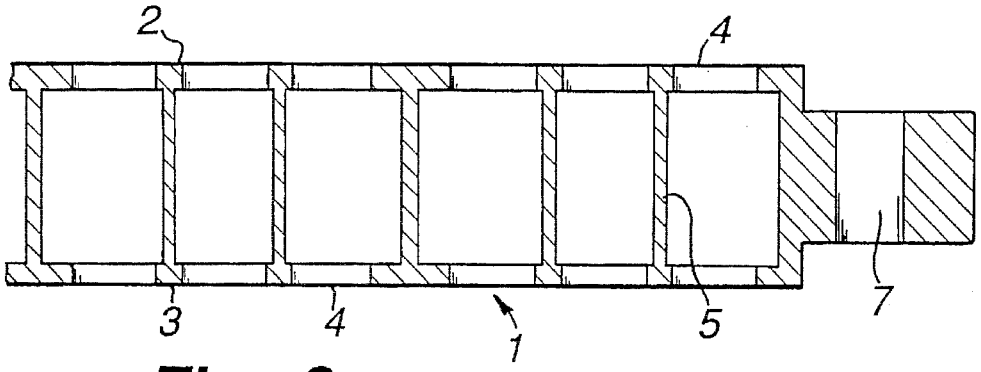
FIG. 2 is a sectional view through the support member of FIG. 1.

Referring firstly to FIG. 1 there is shown therein a support member 1 in the form of a hollow plastics tubular member of generally square cross-section. Two opposing sides 2, 3—sides of the tubular support member 1 that will be vertical when the support member is secured to a wall in a manner to be described—are provided with a plurality of rectangular apertures 4 which define engagement locations as will be described below. In the embodiment shown each side is provided with twelve apertures 4 arranged in four groups of three. the number and arrangement of such apertures may however be selected at will, though the number and arrangement should be the same on both sides 2, 3 of the support member 1. Between the apertures 4 the support member is formed with a plurality of web members 5 extending from one side 2 to the other opposing side 3 to provide strengthening of the support member 1.

At one end—the end which in use will be remote from the wall—the tubular support member 1 is closed. At the other end, however, the support member is provided with means 6 for pivotally mounting the support member 1. This mounting means 6 comprises an aperture 7 for receiving a pin (FIG. 3) and a semicircular toothed portion 9 concentric with the aperture 7.

Figure 3:
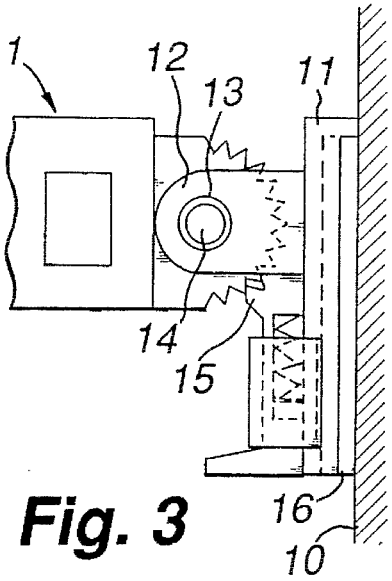
FIG. 3 is a side view showing in detail one end of the support member of FIGS. 1 & 2, FIGS. 4(*a*), (*b*) & (*c*) show how the support member may be fixed to the surface of a wall.

As can be best seen in FIG. 3 the support member 1 is mounted to a wall surface 10 via a support bracket 11. Support bracket 11 comprises a pair of upstanding bracket arms 12 each provided with an aperture 13 at one end thereof and between which apertures is located a pin 14. Pin 14 extends through the aperture 7 formed at the end of the support arm 1 to allow the support arm to rotate about the axis of the pin 14.

The support bracket 11 is also provided with a toothed member 15 adapted to engage the teeth formed on toothed portion 9 so as to lock the support member against rotation, but which may be moved out of this engaging condition so as to allow the support arm 1 to be rotated into a new position. Preferably the toothed member 15 is resiliently biased into engagement with the toothed portion 9.

Figure 4A:
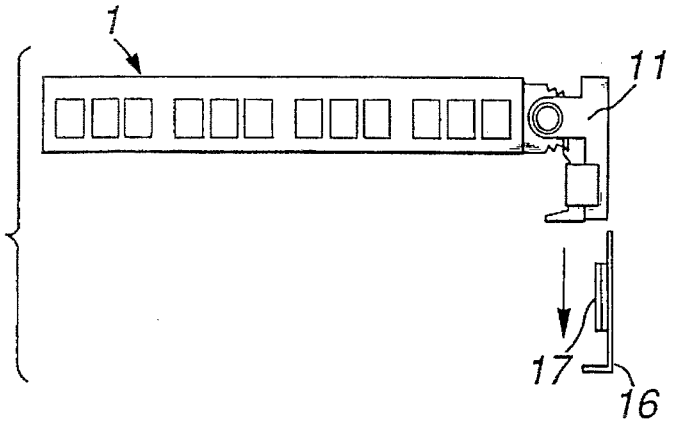
Figure 4B:
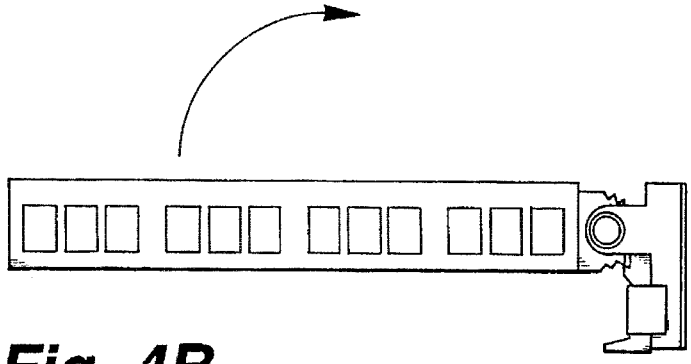
Figure 4C:
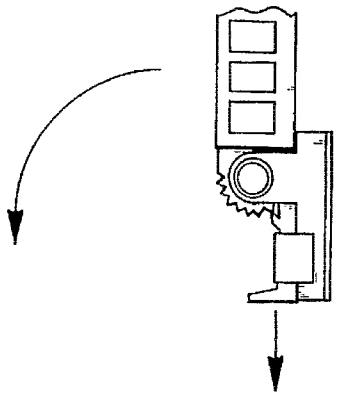

The support bracket 11 could be directly secured to the wall, but preferably it is releasably secured such that when not in use the towel rack may be removed out of the way. This may be achieved by fixing to the wall, for example by screws, a holding member 16 formed with locking member 17 adapted to engage a correspondingly shaped locking channel formed on the base of the support bracket 11. Thus, as is shown in FIGS. 4(*a*)–(*c*) the support arm 1 is mounted to a wall by slidably fixing the support bracket 11 onto the holding member 16 such that the locking member 17 engages the locking channel formed on the support bracket 11. Once the support bracket 1 has been fixed onto the holding member 16 the position of the support arm 1 may be adjusted by releasing the locking toothed member 15 by moving it in the direction of the arrow in FIG. 4(*c*) before rotating the support arm 1 into a desired position.

Figure 5:
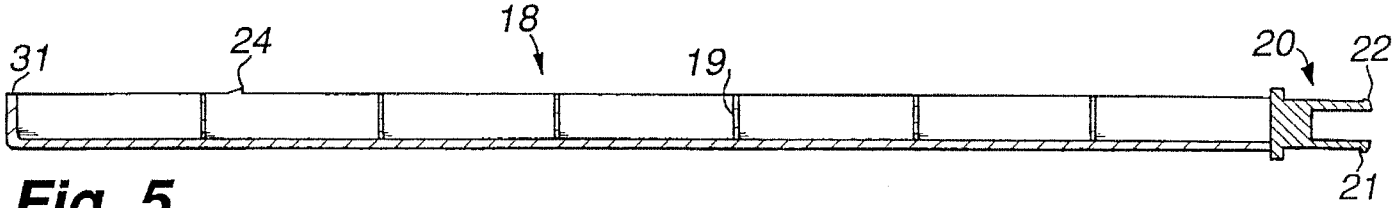
FIG. 5 is a sectional view through a towel rail according to one embodiment of the invention.
Figure 6:
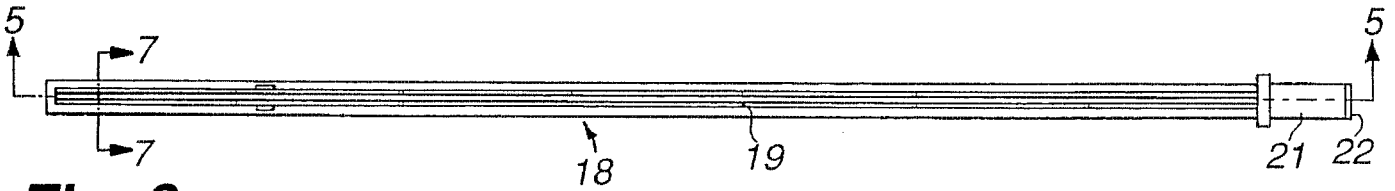
FIG. 6 is a plan view of the towel rail of FIG. 5.
Figure 7:
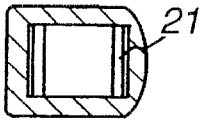
FIG. 7 is an end view of the towel rail of FIG. 5.

FIGS. 5 to 7 show a towel rail 18. The towel rail 18 comprises an elongate plastics member. The towel rail 18 is generally hollow, but need not necessarily be completely enclosed. Preferably the towel rail 18 is formed with a plurality of re-inforcing cross web members 19 to give added strength. At one end each towel rail is provided with engagement means 20 by means of which they may releasably engage the apertures 4 formed in the support arm 1. Each engagement means comprises a pair of spaced apart resilient locking arms 21 formed at the end thereof with respective locking lugs comprising hooked portions 22.

Figure 8:
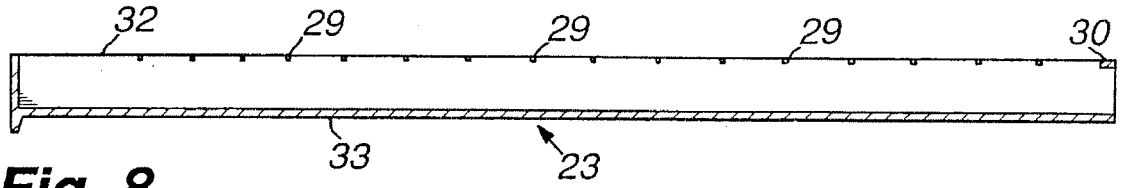
FIG. 8 is a sectional view of a sliding towel rail, FIGS. 9(*a*)–(*c*) show how the towel rail may be engaged with the support member.

FIG. 8 shows a sliding towel rail 23 approximately the same length as towel rail 18. The sliding towel rail 23 has a similar shaped cross-section as towel rail 18 but of a larger dimension such that the rail 18 may be telescopically received within the sliding towel rail 23 for relative movement. In practice the towel rail 18 will be fixed to the support arm 1 and the sliding towel rail 23 may be moved to increase the length of the towel rail available for use. A stop member 24 is formed on the towel rail 18 which may engage an end 30 of the sliding towel rail 23 to prevent the sliding rail from becoming detached from the inner towel rail 18. Also formed near the top and along the top edge of the length of the sliding rail are a pluarlity of guiding lugs 29 which together with the lower side 33 of the sliding rail 23 form a sheathe for the towel rail 18 so that the sliding rail 23 only moves along a direction which is substantially parallel to the axis of the towel rail 18.

Figure 9A:
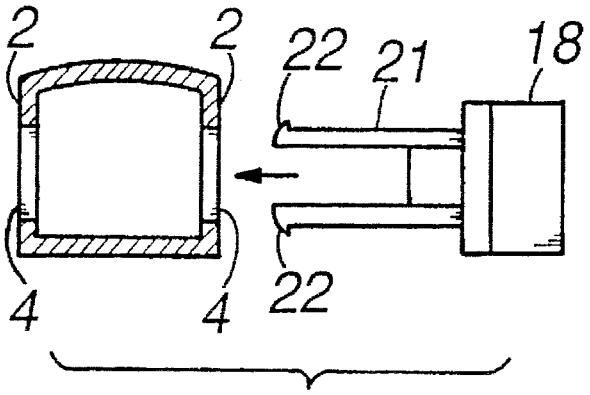
Figure 9B:
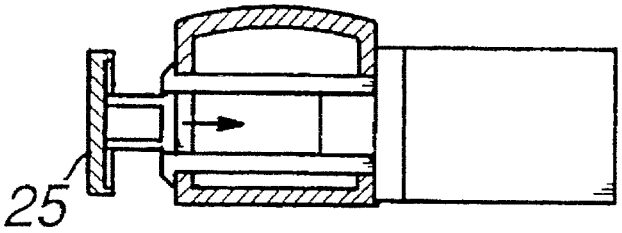
Figure 9C:
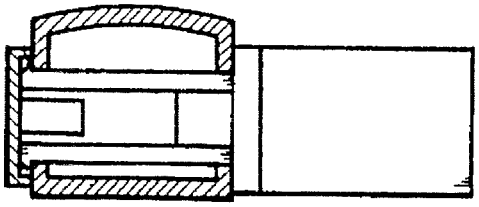

FIGS. 9(*a*)–(*c*) show how the towel rail 18 is engaged to the support member 1. The locking arms 21 are spaced apart by a distance slightly greater than the dimensions of aperture 4 but may be received within the aperture by urging the arms 21 together. The length of the locking arms 21 is such that they will just extend from one side 2 of the support arm to the other side 3 in such a manner that the hooked portions 22 formed at the ends of the locking arms engage the edges of an aperture 4 in the surface 3 corresponding in location to the aperture 4 in the side 2 through which the arms 21 are located. Together with the resilient nature of the arms 21 the towel rail 18 will thus be tightly mounted to the support member, but may be released by pressing the arms 21 inwardly to release the hooked portions 22 from engagement with the aperture 4.

The engagement of the towel rail 18 with the support member 1 may be strengthened, however, by providing an additional locking member in the form of a T-shaped plug 25. This T-shaped plug 25 is adapted to be received between the locking arms 21 and is dimensioned such as to urge the arms 21 apart and into engagement with the apertures 4.

Figure 10:
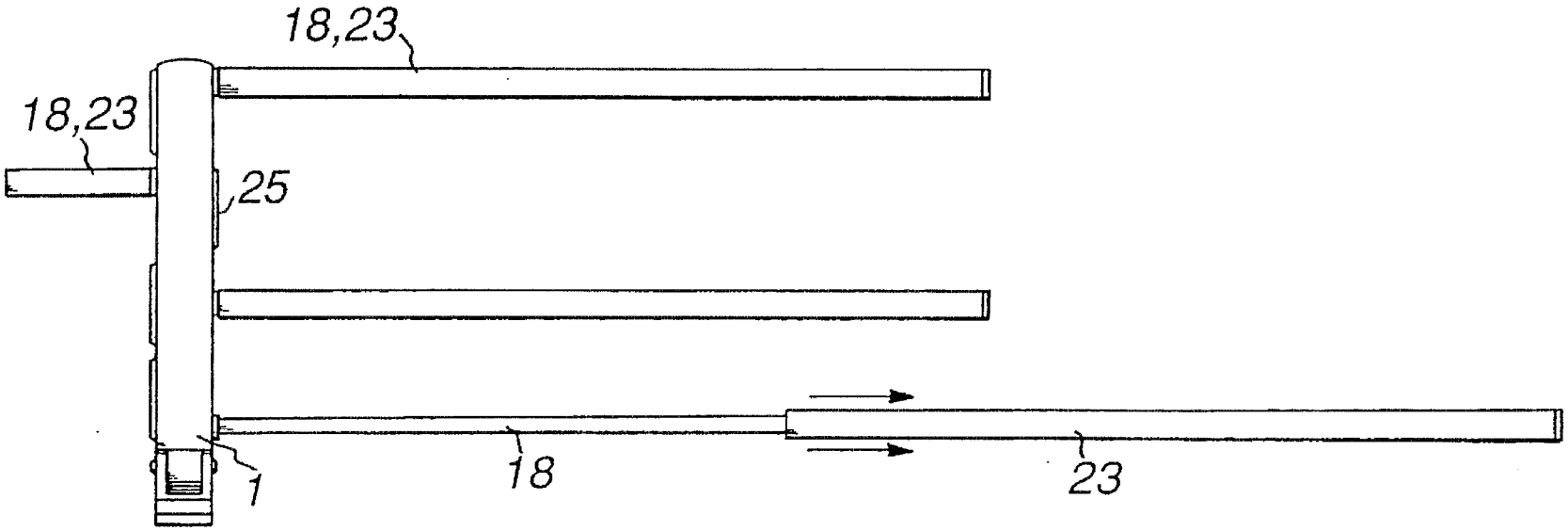
FIG. 10 shows one possible completed towel rack in accordance with the present invention.

It will be understood that the towel rack may be constructed by locating individual towel rails in selected apertures, with the configuration, ie the number and location of the rails, being selected as desired by a user. One possible configuration is illustrated in FIG. 10. If longer towel rails are needed the sliding towel rail 23 may be moved to increase the length of the total rail. Towel rails may be fitted to the support arm 1 on either side, though rails cannot be put on both sides of the support arm at the same location at the same time.

The ability to select the number, location and length of the towel rails provides the system of this invention with great flexibility and versatility. In addition the angle of the support member to the wall may also be adjusted. When not in use, the towel rails may be removed from the support arm and the arm rotated so that it is flat against the wall and out of the way, or indeed the support arm may also be removed from the wall by disengaging it from the holding member. Thus when not in use the towel rack of this invention does not cause an obstruction.

Although the invention has been described with reference to the hanging of towels, it will of course be understood that the invention is not so limited and that the "towel" rack of the present invention may be used for hanging many other items such as clothes, pillow cases, sheets and others.

I claim:

1. A towel rack comprising, a support member, said support member being adapted to be mounted to a wall in use so as to extend away from said wall, and a plurality of towel rails adapted to receive towels thereon when in use, said support member being provided with a plurality of engagement locations, and said rails being adapted to be releasably engageable with said support member at a said engagement location.

2. A towel rack as claimed in claim 1 wherein said towel rails are telescopic whereby their length may be adjusted.

3. A towel rack as claimed in claim 1 wherein said support member is adapted in use for rotation in a vertical plane perpendicular to the wall to which the support member is mounted such that the angle of the support member relative to the wall may be adjusted.

4. A towel rack as claimed in claim 3 wherein means are provided to lock the angular position of the support member relative to the wall.

5. A towel rack as claimed in claim 1 wherein each said engagement location comprises an aperture in the support member, and each said towel rail is provided at one end thereof with a pair of spaced apart resilient locking arms, said locking arms being spaced apart by a distance slightly greater than the width of said apertures.

6. A towel rack as claimed in claim 5 wherein the support member is hollow and complementary apertures are provided on each side of the support member, the length of said locking arms being slightly greater than the width of said support member such that the locking arms will extend through both a first aperture on one side of the support member and a complementary second aperture on the opposed side of the support member, and the free ends of said locking arms being provided with locking lugs for engaging the edges of said second complementary aperture.

7. A towel rack as claimed in claim 6 wherein a locling member is provided and adapted to be received between said locking arms so as to urge said arms apart and into engagement with said apertures.

8. A towel rack as claimed in claim 7 wherein said locking member comprises a T-shaped plug.

9. A towel rack as claimed in claim 1 wherein said support member is removably mountable to said wall.

* * * * *